US008444104B2

(12) United States Patent
Li

(10) Patent No.: US 8,444,104 B2
(45) **Date of Patent: *May 21, 2013**

(54) SECURE MECHANISM OF PORTABLE ACCESSORY DEVICE FOR OUTDOOR UMBRELLA

(75) Inventor: Wanda Ying Li, Baldwin Park, CA (US)

(73) Assignee: Oliver Joen-An Ma, Arcadia, CA (US)

( * ) Notice: Subject to any disclaimer, the term of this patent is extended or adjusted under 35 U.S.C. 154(b) by 1554 days.

This patent is subject to a terminal disclaimer.

(21) Appl. No.: 11/985,402

(22) Filed: Nov. 14, 2007

(65) Prior Publication Data

US 2009/0120475 A1 May 14, 2009

(51) Int. Cl.
*F16M 13/00* (2006.01)

(52) U.S. Cl.
USPC ..... 248/523; 248/519; 135/16; 135/91

(58) Field of Classification Search
USPC . 135/16, 910, 96, 21, 91, 98, 159; 248/230.4, 248/230.3, 231.41, 231.21, 316.8, 523, 125.2, 248/157, 218.4, 219.3, 222.12, 222.51, 229.12, 248/229.22, 295.11, 327, 519, 524, 525, 248/526, 346.01, 346.03, 346.04, 346.06; 362/102, 120, 191, 196, 431, 145
See application file for complete search history.

(56) References Cited

U.S. PATENT DOCUMENTS

| | | | | |
|---|---|---|---|---|
| 3,449,002 | A * | 6/1969 | Bernard | 403/373 |
| 5,996,511 | A * | 12/1999 | Swoger | 108/157.13 |
| 6,959,996 | B2 * | 11/2005 | Ip | 362/102 |
| 7,401,936 | B1 * | 7/2008 | Fan | 362/102 |
| 7,497,583 | B2 * | 3/2009 | Ma | 362/102 |
| 7,695,153 | B2 * | 4/2010 | Tsai | 362/102 |
| 2007/0242450 | A1 * | 10/2007 | Blatecky | 362/102 |
| 2009/0014041 | A1 * | 1/2009 | Li | 135/16 |
| 2009/0196020 | A1 * | 8/2009 | Tsai | 362/102 |

* cited by examiner

*Primary Examiner* — Terrell McKinnon
*Assistant Examiner* — Eret McNichols
(74) *Attorney, Agent, or Firm* — Raymond Y. Chan; David and Raymond Patent Firm

(57) ABSTRACT

A portable accessory device includes a housing having a mounting slot, an accessory unit supported in the housing, and two adjustable retainers for adjusting the size of the mounting slot for a shaft of the outdoor umbrella. Each of the adjustable retainer includes a retention arm, having a pusher surface facing towards the mounting slot, slidably mounted at the housing, wherein the pusher surfaces of the retention arms are facing with each other and are arranged for biasing against an outer surface of the shaft of the outdoor umbrella until the shaft thereof being fitted at the mounting slot so as to substantially mount the housing at the shaft of the outdoor umbrella. Therefore, the portable accessory device is adapted to detachably mount at the outdoor umbrella to provide an additional function via the accessory unit for users to have high quality outdoor activities.

10 Claims, 11 Drawing Sheets

SECURE MECHANISM OF PORTABLE ACCESSORY DEVICE FOR OUTDOOR UMBRELLA

BACKGROUND OF THE PRESENT INVENTION

1. Field of Invention

The present invention relates to an accessory device, and more particularly to a portable accessory device for an outdoor umbrella, wherein the accessory device is coupled with a main shaft of the outdoor umbrella to act as a mobile radio or a lighting fixture.

2. Description of Related Arts

Outdoor umbrellas are usually set up at outdoor area, such as the patio area, garden area, campground or beach area, to give a pleasant shade for a user, wherein a conventional outdoor umbrella comprises a supporting frame with a stand having a predetermined weight and a support shaft upwardly extended from the stand, and a foldable awning supported by the supporting frame for providing a shading area.

While enjoying the shading area provided by the outdoor umbrella, people may need some entertainment equipment such as stereo or other electronic devices to provide music, or in the nighttime, people may need a lighting device to provide illumination for them to keep staying outside. Under the circumstances, it is inconvenient and impractical for the user to extend an electrical cord from the dwelling to the patio or garden area, much less the campground or beach area. In other words, the outdoor umbrellas, as the name implies, are designed for use in outdoors, existence of an electrical power source cannot be guaranteed. Thus, an accessory device which is secured on the outdoor umbrella structure and adapted for providing entertainment and illumination functions is highly preferable.

Actually, some outdoor umbrellas with lighting and entertainment systems are developed. Almost all of these existing outdoor umbrellas utilize conventional electrical power source to activate either the lighting or entertainment system. In other words, for each of those outdoor umbrellas, an external power source is necessary to provide electrical power to the lighting or entertainment system.

When the lighting or entertainment system is integrated into an accessory device of the outdoor umbrella, the problem presented above can most likely be solved. More specifically, for example, a battery unit can be installed in the accessory device to provide electrical power to the lighting or entertainment system. Also, an accessory device can usually be detached from the outdoor umbrella and if there is a built-in rechargeable battery system, it can be recharged when the accessory device is detached from the outdoor umbrella. Thus, the accessory device providing entertainment and illumination functions is highly preferable and how to securely fasten the accessory device onto the outdoor umbrella is important.

SUMMARY OF THE PRESENT INVENTION

A main object of the present invention is to provide a portable accessory device with a pair of adjustable retainers for adjusting the size of a mounting slot, wherein each adjustable retainer has a retention arm adapted for biasing against an outer surface of a shaft of an outdoor umbrella until the shaft thereof being fitted at the mounting slot so as to substantially mount the portable accessory device at the outdoor umbrella.

Another object of the present invention is to provide a portable accessory device with a built-in audio system and/or a light fixture to provide entertainment and/or illumination function when a user enjoys a shading area under the outdoor umbrella.

Another object of the present invention is to provide a portable accessory device with a pair of retention arms adapted for selectively adjusting the size of said mounting slot with respect to said shaft of said outdoor umbrella, such that the accessory device can be mounted at the outdoor umbrella shafts with different sizes.

Another object of the present invention is to provide a portable accessory device with the audio system and/or lighting fixture built in, wherein the portable accessory device comprises a rechargeable battery unit which provides electrical power to the audio system and/or lighting fixture, and can be recharged from an external electrical power source.

Another object of the present invention is to provide a portable accessory device, wherein the accessory device comprises a first and a second housing body defining the mounting slot when the first and second housing bodies are coupled with each other, and the mounting slot has a size for a shaft of said outdoor umbrella fitting therewithin.

These and other objectives, features, and advantages of the present invention will become apparent from the following detailed description, the accompanying drawings, and the appended claims.

DETAILED DESCRIPTION OF THE PREFERRED EMBODIMENT

Figure 7:
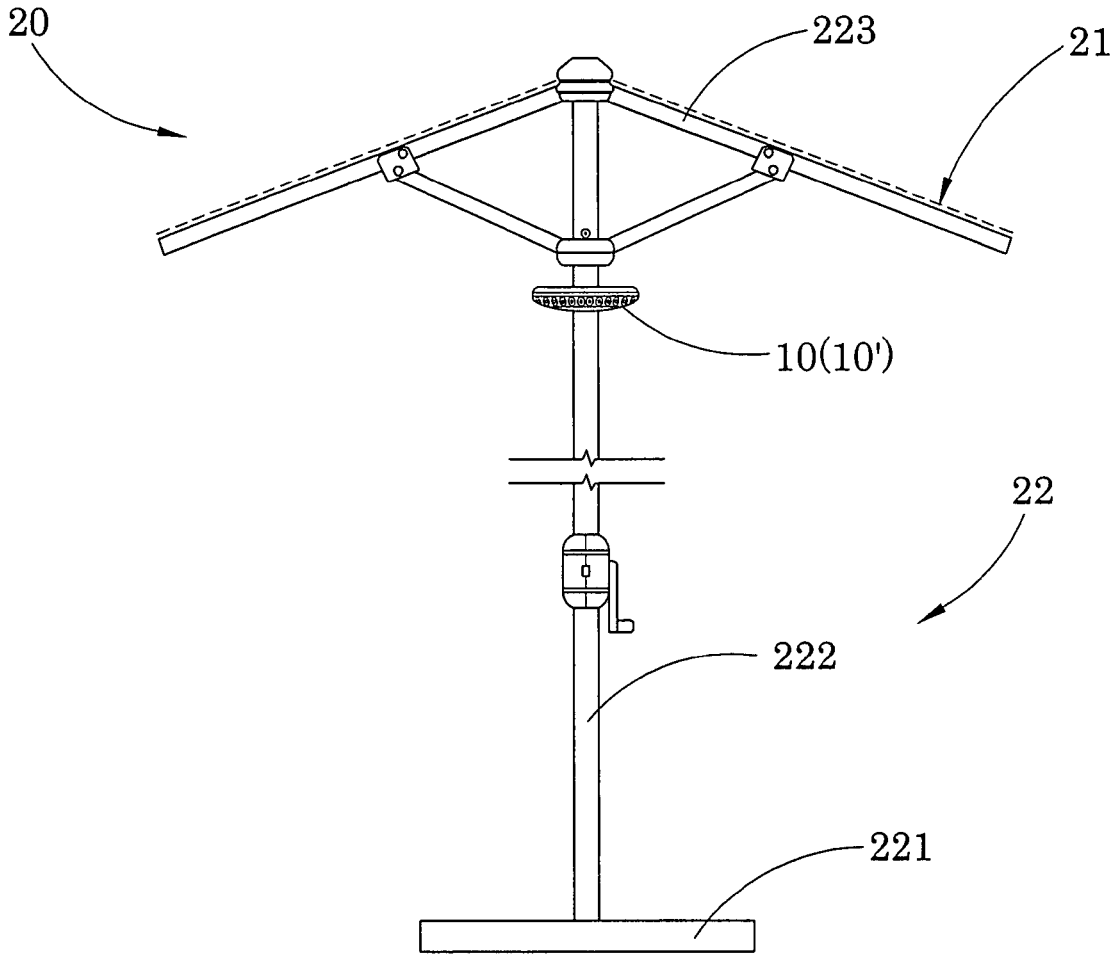
FIG. 7 is a schematic view of the outdoor umbrella incorporating with the portable accessory device.
Figure 8:
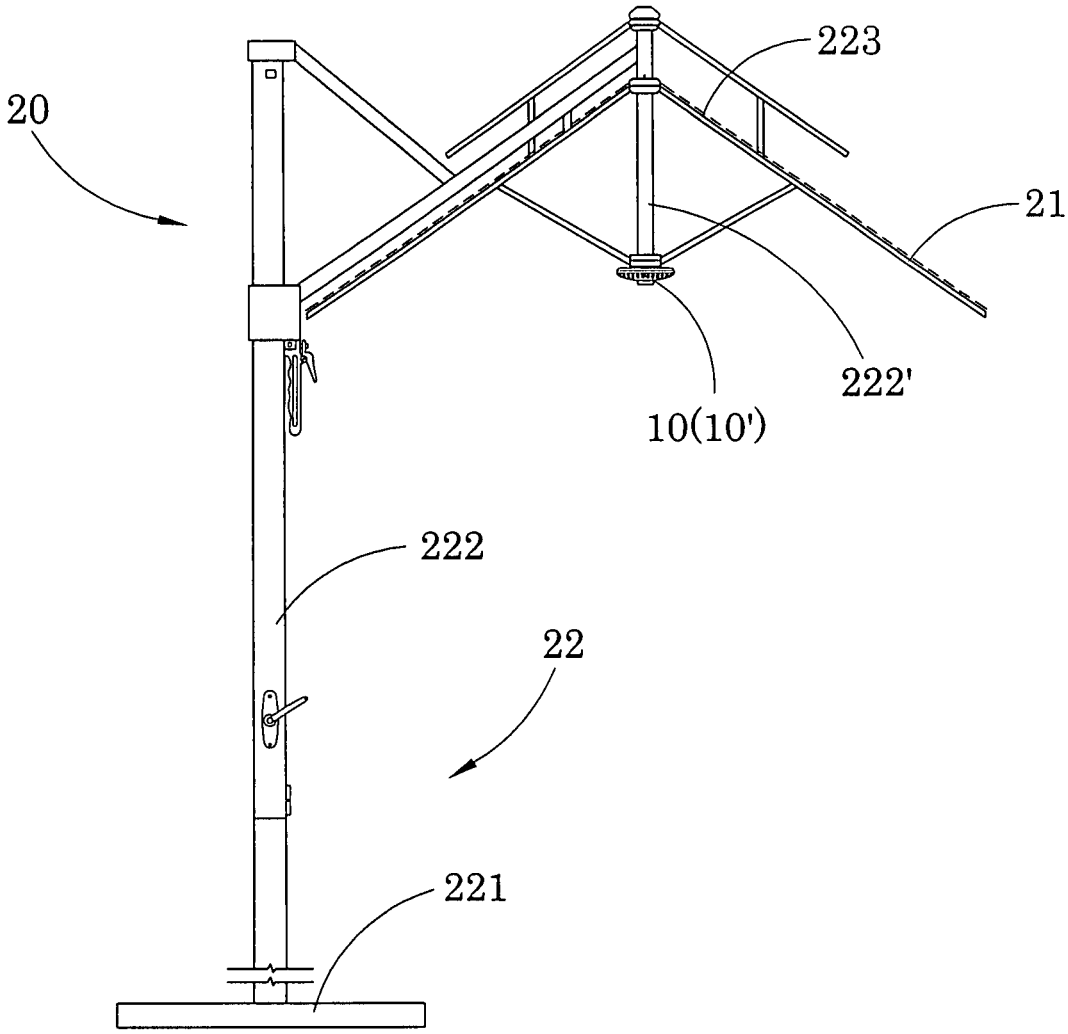
FIG. 8 is a schematic view of an alternative outdoor umbrella incorporating with the portable accessory device.

Referring to FIGS. 7 and 8, a portable accessory device 10 for an outdoor umbrella 20 according to a preferred embodiment of the present invention is illustrated. According to the preferred embodiment, the outdoor umbrella 20 comprises an umbrella awning 21 and an umbrella frame 22 which supports the umbrella awning 21. The umbrella frame 22 comprises a base 221, a shaft 222 vertically mounted on top of the base 221, and a foldable awning frame 223 supported by the shaft 222 and coupled with the umbrella awning 21 to define a shading area. Accordingly, the portable accessory device 10 of the present invention is adapted to detachably mount at the shaft 222 of the umbrella frame 22 as shown in FIG. 7 or the shaft 222' of the awning frame 223 as shown in FIG. 8. Accordingly, the portable accessory device 10 is supported within the shading area of the outdoor umbrella 20.

The shading area under the outdoor umbrella 20 may provide a good place for people to enjoy outdoor activities and avoid overexposure to the sunlight. However, people may have more varieties in their outdoor activities if they have music therewith. Also, they may need illumination if they want to stay outside during the nighttime. Accordingly, the portable accessory device 10 comprises a housing 30, an accessory unit 40 supported in the housing 30 for providing an addition function for the outdoor umbrella 20, and a shaft adjusting arrangement 50 as a secure mechanism to detachably mount the housing 30 at the outdoor umbrella 20.

The housing 30 comprises a first housing body 31 and a second housing body 32 defining a mounting slot 301 when the first and second housing bodies 31, 32 are coupled with each other, wherein the mounting slot 301 has a size for the shaft 222 of the outdoor umbrella 20 fitting therewithin.

Figure 1:
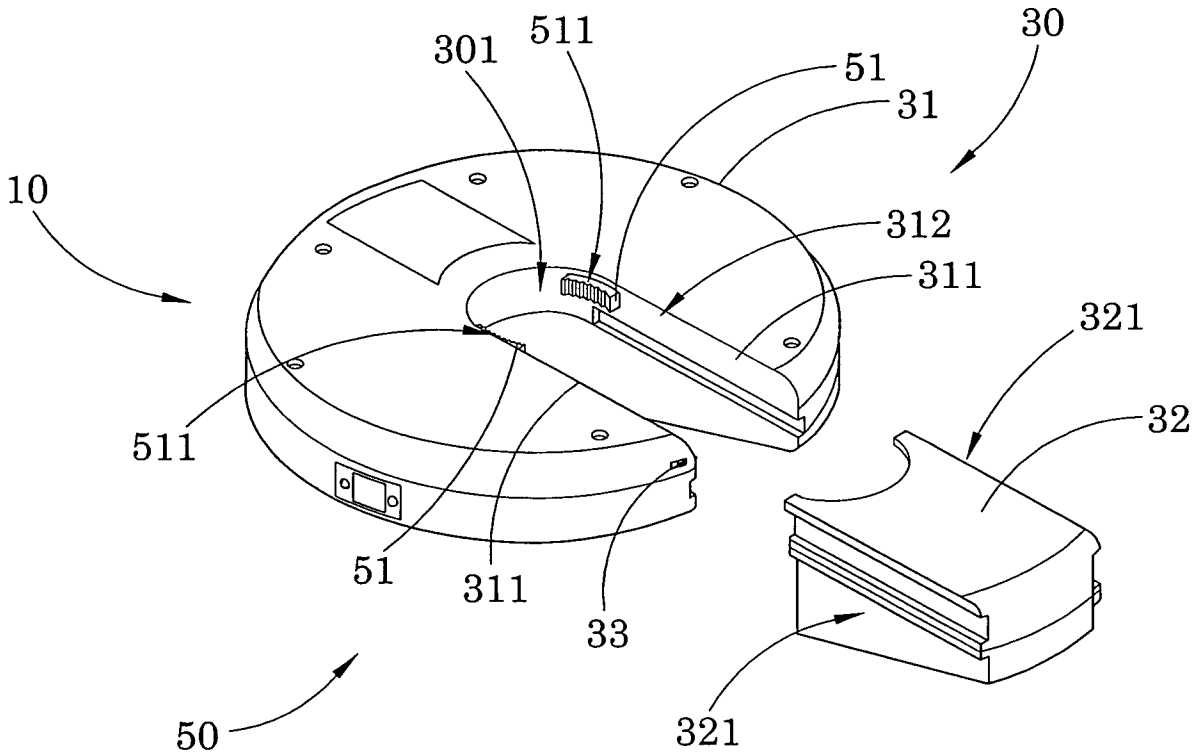
FIG. 1 is a perspective view a portable accessory device for an outdoor umbrella according to a first preferred embodiment of the present invention.
Figure 2:
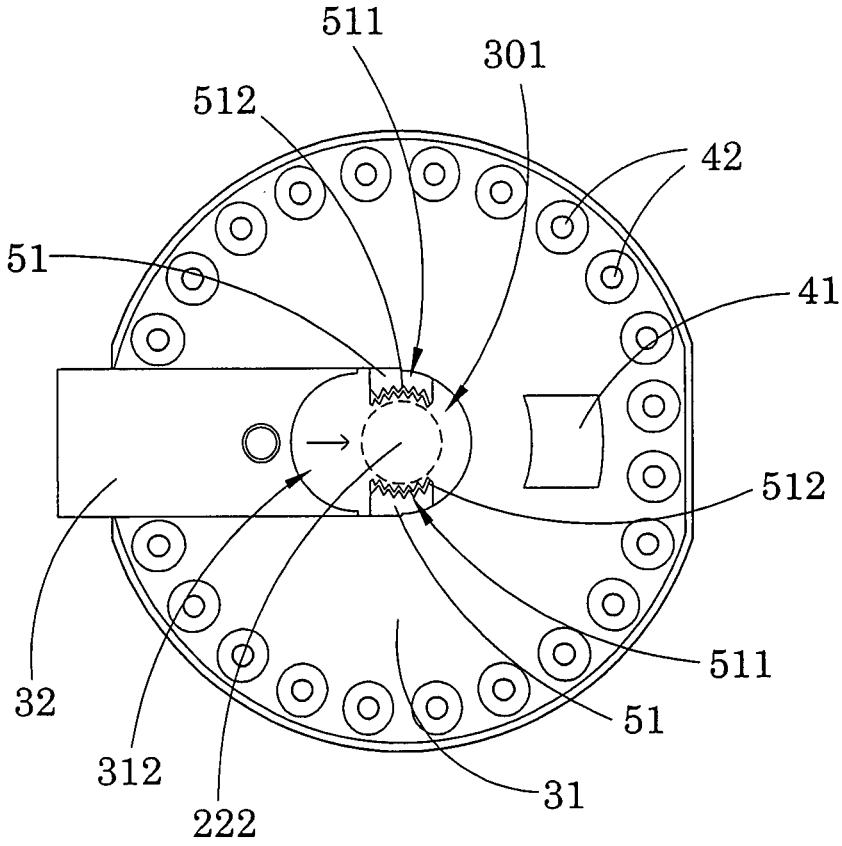
FIG. 2 is a schematic view of the portable accessory device for the outdoor umbrella according to the above first preferred embodiment of the present invention.

As shown in FIG. 1, the first housing body 31, having a U-shaped structure, has two inner guiding walls 311 defining a guiding channel 312 therebetween. The second housing body 32, having a corresponding elongated shape, has two outer guiding walls 321 engaging with the inner guiding walls 311 of the first housing body 31. When the first and second housing bodies 31, 32 are mounted with each other, the housing 30 is formed to have a donut shape and to define the mounting slot 301 at a center of the housing 30.

In other words, the guiding channel 312 has a closed end defining the mounting slot 301 thereat, and an opened end is arranged when the second housing body 32 is slidably mounted to the first housing body 31 along the guiding channel 312 through the opened end thereof, the mounting slot 301 is formed at the closed end of the guiding channel 312. A housing locker 33 is provided to releasably lock up the second housing body 32 with the first housing body 31.

The accessory unit 40, according to the first embodiment, is a lighting fixture supported in the housing 30, wherein the accessory unit 40 comprises a battery unit 41 supported in the first housing 31 and a plurality of LEDs 42 spacedly mounted at the first housing 31 and electrically connected to the battery unit 41 for illuminating the shading area of the outdoor umbrella 20 as the additional function. Accordingly, head portions of the LEDs 42 are protruded from a bottom side of the housing 30 through the holes thereof.

According to the preferred embodiment, the shaft adjusting arrangement 50 comprising two adjustable retainers 51 for adjusting the size of the mounting slot 301 for the shaft 222 of the outdoor umbrella 20, wherein each of the adjustable retainers is an elongated retention arm, having a pusher surface 511 facing towards the mounting slot 301, slidably mounted at the first housing body 31. The pusher surfaces 511 of the adjustable retainers 51 are facing with each other and are arranged for biasing against an outer surface of the shaft 222 of the outdoor umbrella 20 until the shaft 222 thereof being fitted at the mounting slot 301 so as to substantially mount the housing 30 of the portable accessory device 10 at the shaft 222 of the outdoor umbrella 20.

Figure 3:
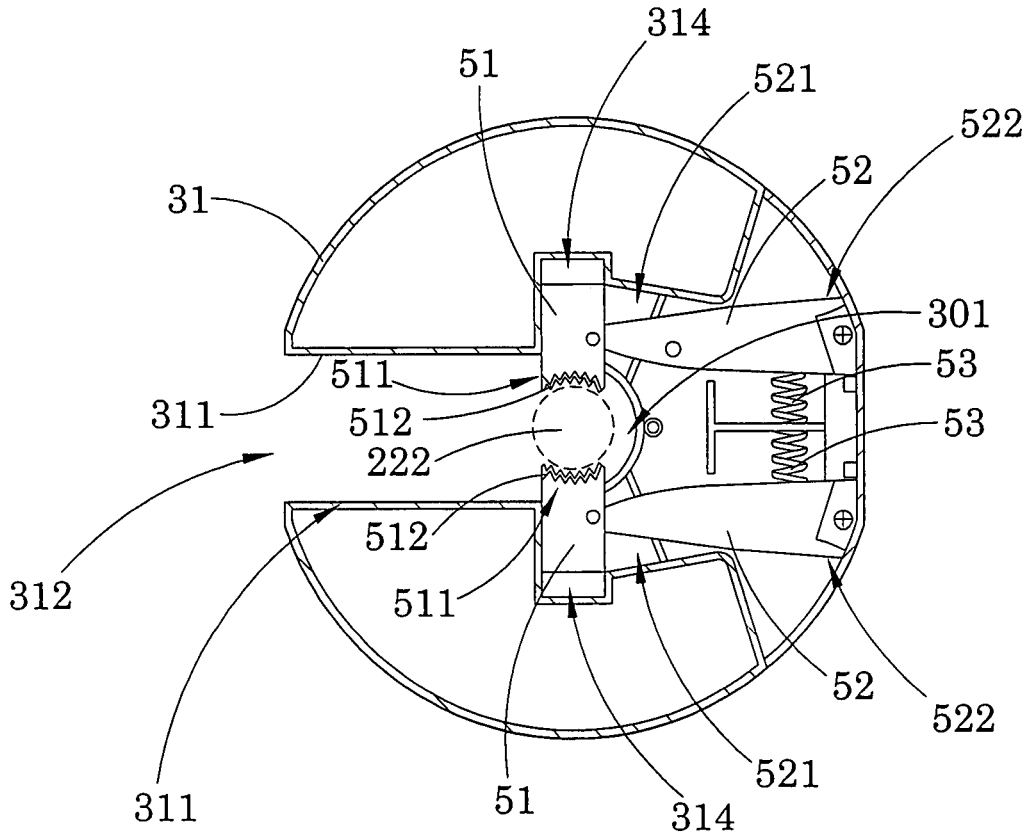
FIG. 3 is a sectional view of the first housing body of the portable accessory device for the outdoor umbrella according to the above first preferred embodiment of the present invention.

As shown in FIG. 3, each of the adjustable retainers 51 illustrated above comprises a pusher head defining the pusher surface 511 thereat towards the mounting slot 301 that the adjustable retainers 51 are oppositely located with each other. Preferably, the pusher surface 511 of each of the adjustable retainers 51 is a curved surface corresponding to a curvature of the shaft 222 of the outdoor umbrella 20.

In addition, each of the adjustable retainers 51 further comprises an anti-slippery pad 512 provided at the pusher surface 511 thereof for enhancing a frictional engagement between the adjustable retainer 51 and the shaft 222 of the outdoor umbrella 20 so as to securely mount the housing 30 at the shaft 222 of the outdoor umbrella 20.

Accordingly, the adjustable retainers 51 are slidably coupled at the first housing body 31 in a radially movable manner at a position that the pusher surfaces 511 of the adjustable retainers 51 are protruded from a circumferential wall of the mounting slot 301 for biasing against the outer surface of the shaft 222. In other words, the sliding path of each of the adjustable retainers 51 is defined at the diameter of the mounting slot 301 such that the pusher surface 511 of each of the adjustable retainers 51 is guided to slide towards and away from the center of the mounting slot 301.

As shown in FIG. 3, the shaft adjusting arrangement 50 further comprises two actuating members 52 pivotally supported at the first housing body 31 to couple with the adjustable retainers 51 respectively, wherein each of the actuating members 52 has a pivot end 521 pivotally coupling with the corresponding adjustable retainer 51 and an opposed pushing end 522 arranged in such a manner that when the pushing ends 522 of the actuating members 52 are pressed towards each other to pivotally move the pivot ends 521 thereof away from each other, the adjustable retainers 51 are driven to radially slide away from each other so as to adjust a distance between the pusher surfaces 511 of the adjustable retainers 51.

According to the preferred embodiment, each of the actuating members 52 has an elongated structure, wherein each of the actuating members 52 is pivotally coupled with the first housing body 31 at a pivot point between the pivot end 521 of the actuating member 52 and the pushing end 522 thereof. The first housing body 31 further has an operation cavity 310, wherein the pushing ends 522 of the actuating members 52 are extended from an interior of the first housing body 31 to the operation cavity 301. When the user applies a clipping force at the pushing ends 522 of the actuating members 52 to pivotally move the pushing ends 522 of the actuating members 52 towards each other, the pivot ends 521 of the actuating members 52 are pivotally moved away from each other. Therefore, the adjustable retainers 51 are driven to radially and outwardly slide at the first housing body 31 to maximize the distance between the pusher surfaces 511 of the adjustable retainers 51.

The shaft adjusting arrangement 50 further comprises two resilient elements 53 supported in the first housing body 31 for applying pushing forces against the actuating members 52 respectively, wherein each of the resilient elements 53 has two ends biasing against an inner wall of the first housing body 31 and the pushing end 522 of the respective actuating member 52. Therefore, the resilient elements 53 normally apply the pushing forces against the pushing end 522 of the respective actuating member 52 to retain the minimum distance between the pusher surfaces 511 of the adjustable retainers 51. Thus, the pushing forces of the resilient elements 53 also enhance the clipping force of the adjustable retainers 51 to bias against the outer surface of the shaft 222 of the outdoor umbrella 20.

In order to ensure the radially sliding movement of each of the adjustable retainers 51, the first housing body 31 contains two guiding slots 314 for guiding the adjustable retainers 51 respectively in a radially movable manner, wherein an inner end portion of each of the adjustable retainers 51 is slidably engaged with the respective guiding slot 314 to ensure the adjustable retainer 51 being slid in a radially movable manner. Therefore, when the pivot ends 521 of the actuating members 52 are pivotally moved with respect to the pushing ends 522 thereof, the adjustable retainers 51 are only driven to slide in a radially movable manner to the center of the mounting slot 301.

In order to detachably mount the portable accessory device 10 at the shaft 222 of the outdoor umbrella 20, the user must detach the second housing body 32 from the first housing body 31 such that the user is able to slide the first housing body 31 towards the shaft 222. Accordingly, the shaft 222 is guided to slide at the opened end of the guiding channel 312 of the first housing body 31 towards the closed end thereof. Then, the user is able to apply a pushing force at the pushing ends 522 of each of actuating members 52 to drive the adjustable retainers 51 to radially slide at the opposite direction so as to increase the distance between the pusher surfaces 511 of the adjustable retainers 51. Once the distance between the pusher surfaces 511 of the adjustable retainers 51 larger than the diameter of the shaft 222, the shaft 222 can be fitted within the mounting slot 301. Therefore, the user is able to release the pushing force at the actuating members 52 such that the pusher surfaces 511 of the adjustable retainers 51 are automatically pushed to bias against the outer surface of the shaft 222 of the outdoor umbrella 20 so as to securely retain the first housing body 31 at the shaft 222 of the outdoor umbrella 20. The second housing body 32 can be slid back along the guiding channel 312 to form the mounting slot 301 encircling the shaft 222 of the outdoor umbrella 20.

Figure 4:
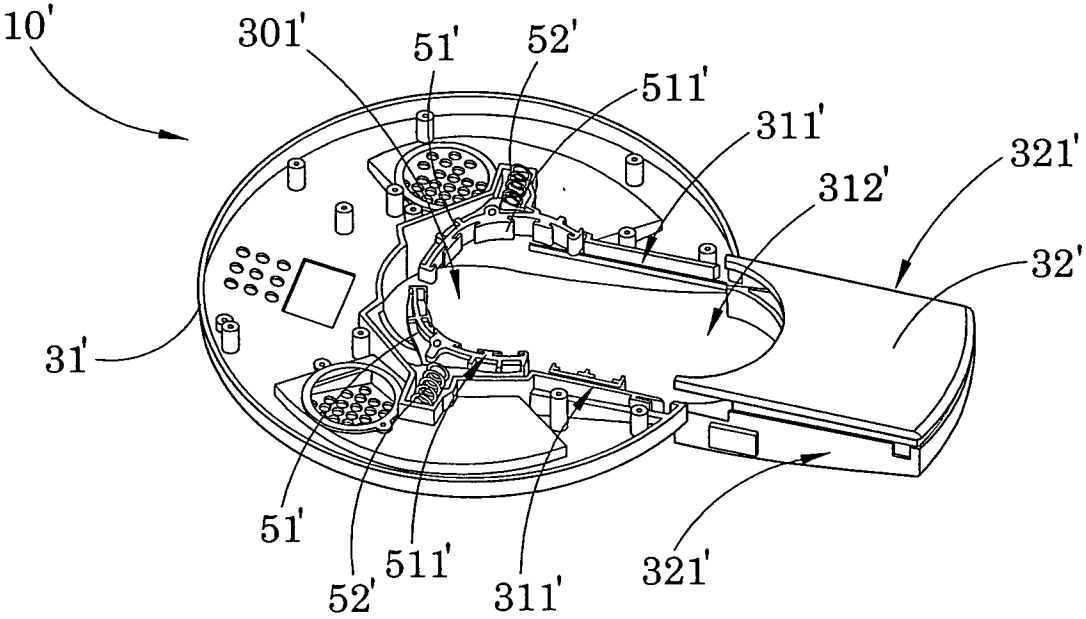
FIG. 4 is a schematic view of the portable accessory device for an outdoor umbrella according to a second preferred embodiment of the present invention, illustrating the V-shaped configuration of the adjustable retainer.
Figure 5:
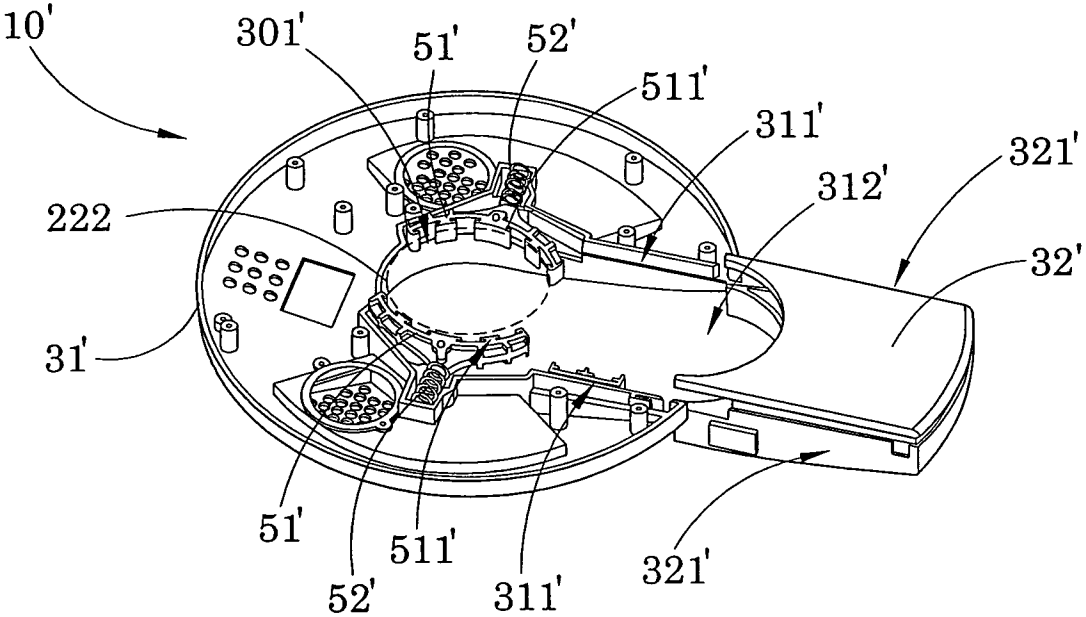
FIG. 5 is a schematic view of the portable accessory device for an outdoor umbrella according to the above second preferred embodiment of the present invention, illustrating the adjustable retainer being bent with the C-shaped configuration.

FIGS. 4 and 5 illustrate the alternative mode of the portable accessory device 10', wherein the portable accessory device 10' comprises a housing 30', an accessory unit 40' supported in the housing 30' for providing an addition function for the outdoor umbrella 20', and a shaft adjusting arrangement 50'.

The housing 30' comprises a first housing body 31' and a second housing body 32' defining a mounting slot 301' when the first and second housing bodies 31', 32' are coupled with each other, wherein the mounting slot 301' has a size for the shaft 222 of the outdoor umbrella 20 fitting therewithin.

As shown in FIG. 4, the first housing body 31', having a U-shaped structure, has two inner guiding walls 311' defining a guiding channel 312' therebetween. The second housing body 32', having a corresponding elongated shape, has two outer guiding walls 321' engaging with the inner guiding walls 311' of the first housing body 31'. When the first and second housing bodies 31', 32' are mounted with each other, the housing 30' is formed to have a donut shape and to define the mounting slot 301' at a center of the housing 30'.

In other words, the guiding channel 312' has a closed end defining the mounting slot 301' thereat, and an opened end is arranged when the second housing body 32' is slidably mounted to the first housing body 31' along the guiding channel 312' through the opened end thereof, the mounting slot 301' is formed at the closed end of the guiding channel 312'.

The accessory unit 40', according to the first embodiment, is an audio system supported in the housing 30', wherein the accessory unit 40' comprises an audio player 41' supported in the first housing 31' and a plurality of speakers 42' spacedly mounted at the first housing 31' and electrically connected to the audio player 41' for playing music and/or broadcasting radio for the outdoor umbrella 20 as the additional function. Accordingly, a bottom side of the housing 30' has a plurality of speaker housing to receive the speakers 42' thereat.

According to the preferred embodiment, the shaft adjusting arrangement 50' comprising two adjustable retainers 51' for adjusting the size of the mounting slot 301' for the shaft 222 of the outdoor umbrella 20, wherein each of the adjustable retainers 51' has an arc shape pivotally coupled at the first housing body 31' at a position that the pusher surfaces 511' of the adjustable retainers 51' are defined at an inner concave surface and are protruded from a circumferential wall of the mounting slot 301' for biasing against the outer surface of the shaft 222. The pusher surfaces 511' of the adjustable retainers 51' are facing with each other and are arranged for biasing against an outer surface of the shaft 222 of the outdoor umbrella 20 until the shaft 222 thereof being fitted at the mounting slot 301' so as to substantially mount the housing 30' of the portable accessory device 10' at the shaft 222 of the outdoor umbrella 20.

Accordingly, each of the adjustable retainers 51' is made of flexible material such that the pusher surface 511' of each of the adjustable retainers 51' is self-adjustably bent to adjust a curvature thereof for biasing against the outer surface of the shaft 222, as shown in FIGS. 4 and 5. In other words, each of the adjustable retainers 51' is a V-shaped flexible member defining a pivot point at a mid-portion of the flexible member. Therefore, each of the adjustable retainers 51' is bent from the V-shaped configuration, as shown in FIG. 4, to a C-shaped configuration, as shown in FIG. 5 with the corresponding curvature of the shaft 222 so as to securely retain the first housing body 31' at the shaft 222 of the outdoor umbrella 20.

Figure 6:
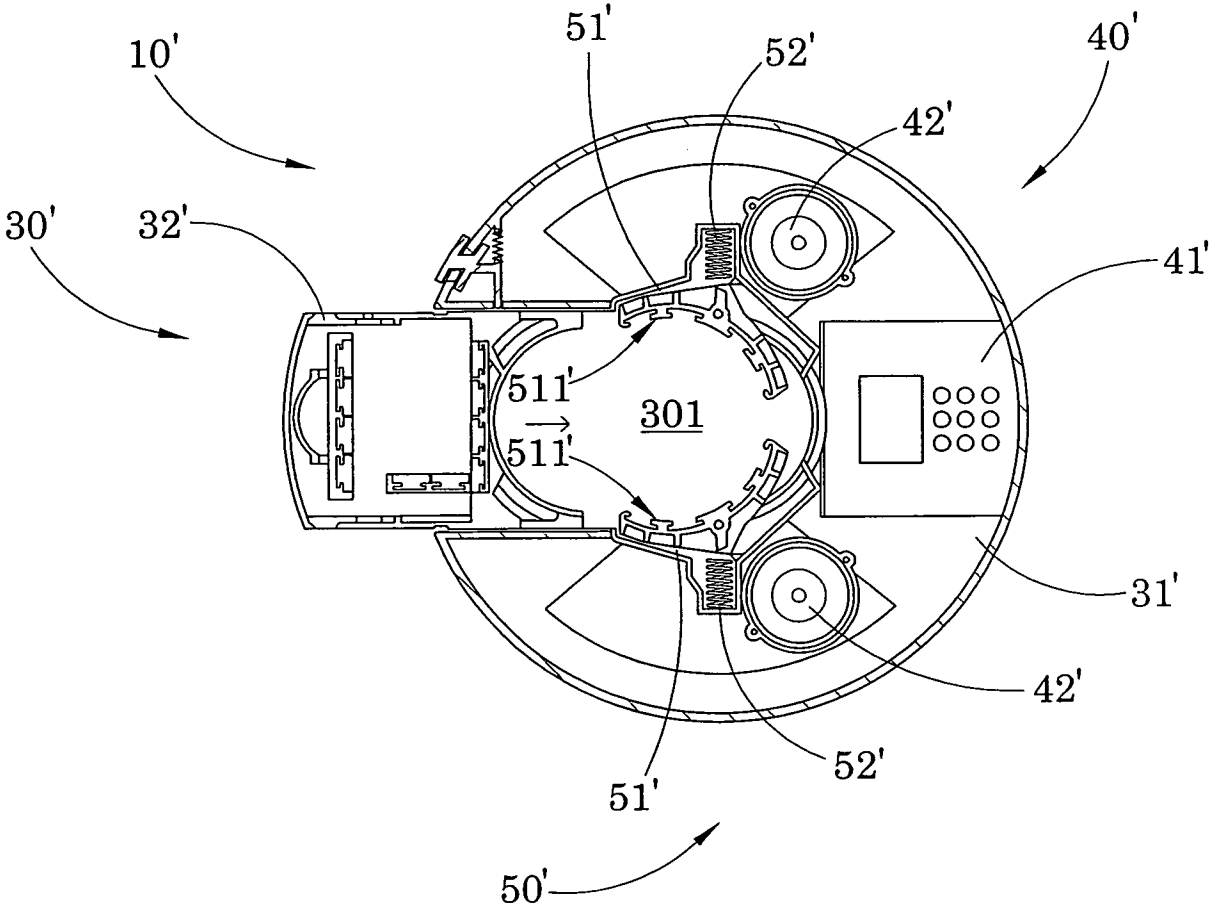
FIG. 6 is a sectional view of the portable accessory device for an outdoor umbrella according to the above second preferred embodiment of the present invention.

As shown in FIGS. 4 to 6, the shaft adjusting arrangement 50' further comprises two resilient elements 52' supported in the first housing body 31' for applying pushing forces against the adjustable retainers 51' respectively, wherein each of the resilient elements 52' has two ends biasing against an inner wall of the first housing body 31' and the respective adjustable retainer 51' at a position offset to the pivot point thereof. Therefore, two corresponding ends of the adjustable retainers 51' are outwardly moved to open up the space toward the opened end of the guiding channel 312' of the first housing body 31' such that the shaft 222 can be slid between the adjustable retainers 51'.

In order to detachably mount the portable accessory device 10' at the shaft 222 of the outdoor umbrella 20, the user must detach the second housing body 32' from the first housing body 31' such that the user is able to slide the first housing body 31 towards the shaft 222. Accordingly, the shaft 222 is guided to slide at the opened end of the guiding channel 312' of the first housing body 31' towards the closed end thereof. Then, the user is able to apply a pushing force at the first housing body 31' until the adjustable retainers 51' is self-bent to bias against the outer surface of the shaft 222 so as to securely retain the first housing body 31' at the shaft 222 of the outdoor umbrella 20. The second housing body 32' can be slid back along the guiding channel 312' to form the mounting slot 301' encircling the shaft 222 of the outdoor umbrella 20.

Furthermore, with the feature of adjustable retainer 51, 51', the portable accessory device 10, 10' of the present invention can be mounted to different sizes of shafts 222 of outdoor umbrellas 20 and different locations thereof, such as the structure shown in FIGS. 7 and 8.

In short, when a user enjoys the shading area under the outdoor umbrella 20 outside the dwelling, such as in the garden or even in the campground, the user may need some music to increase the quality of recreation. The present invention provides the portable accessory device 10, 10' for the outdoor umbrella which a music player can be built in, and more importantly, the portable accessory device 10, 10' can be securely mounted to the shaft 222 of the outdoor umbrella 20, such that it is convenient for the user to carry and operate such a device. In addition, a lighting fixture can also be built in the portable accessory device 10, 10' which can provide illumination when the user needs to use the outdoor umbrella 20 at nighttime.

Figure 9:
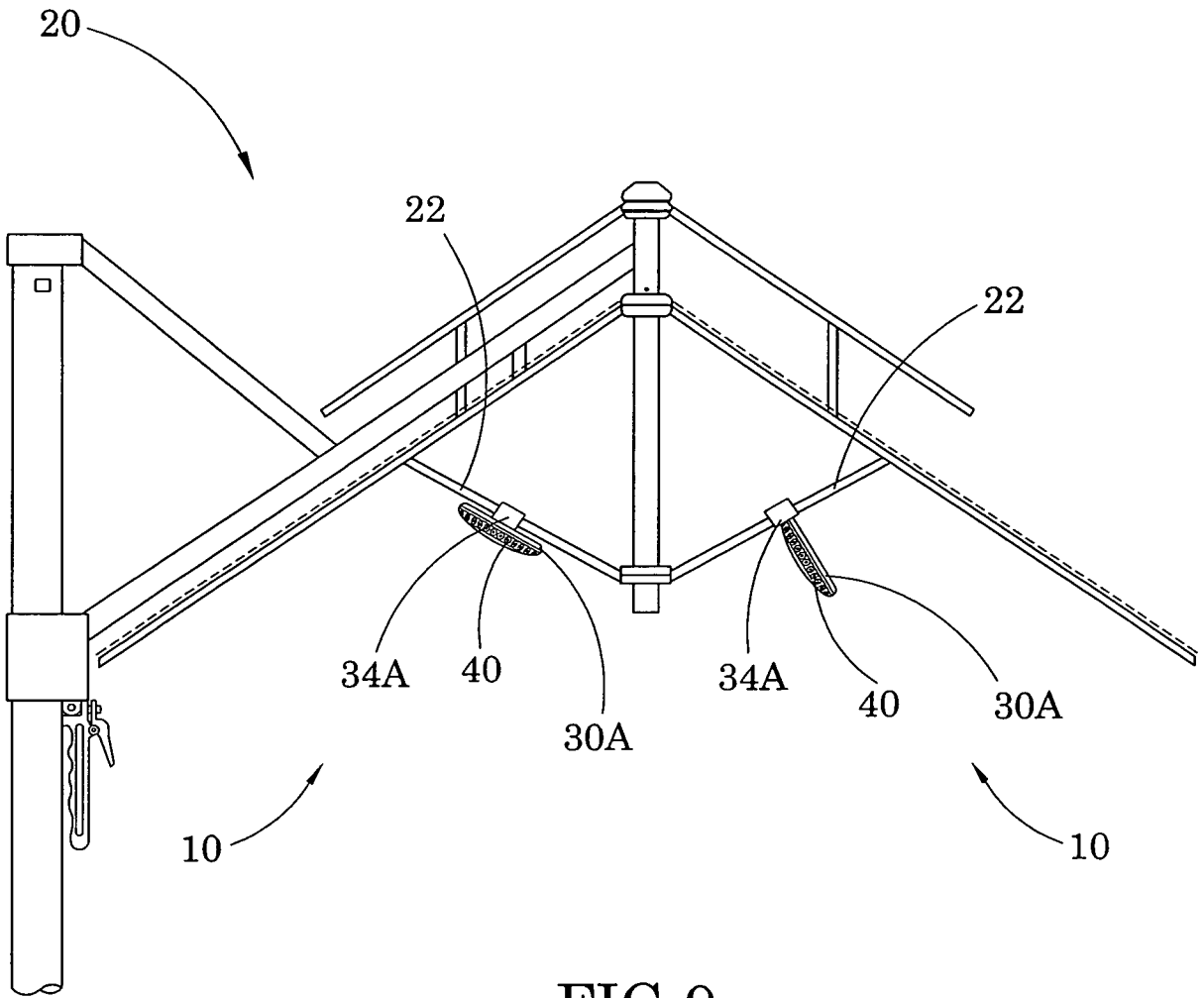
FIG. 9 illustrates an alternative mode of the housing of the portable accessory device for the outdoor umbrella according to the first and second embodiments of the present invention.
Figure 10:
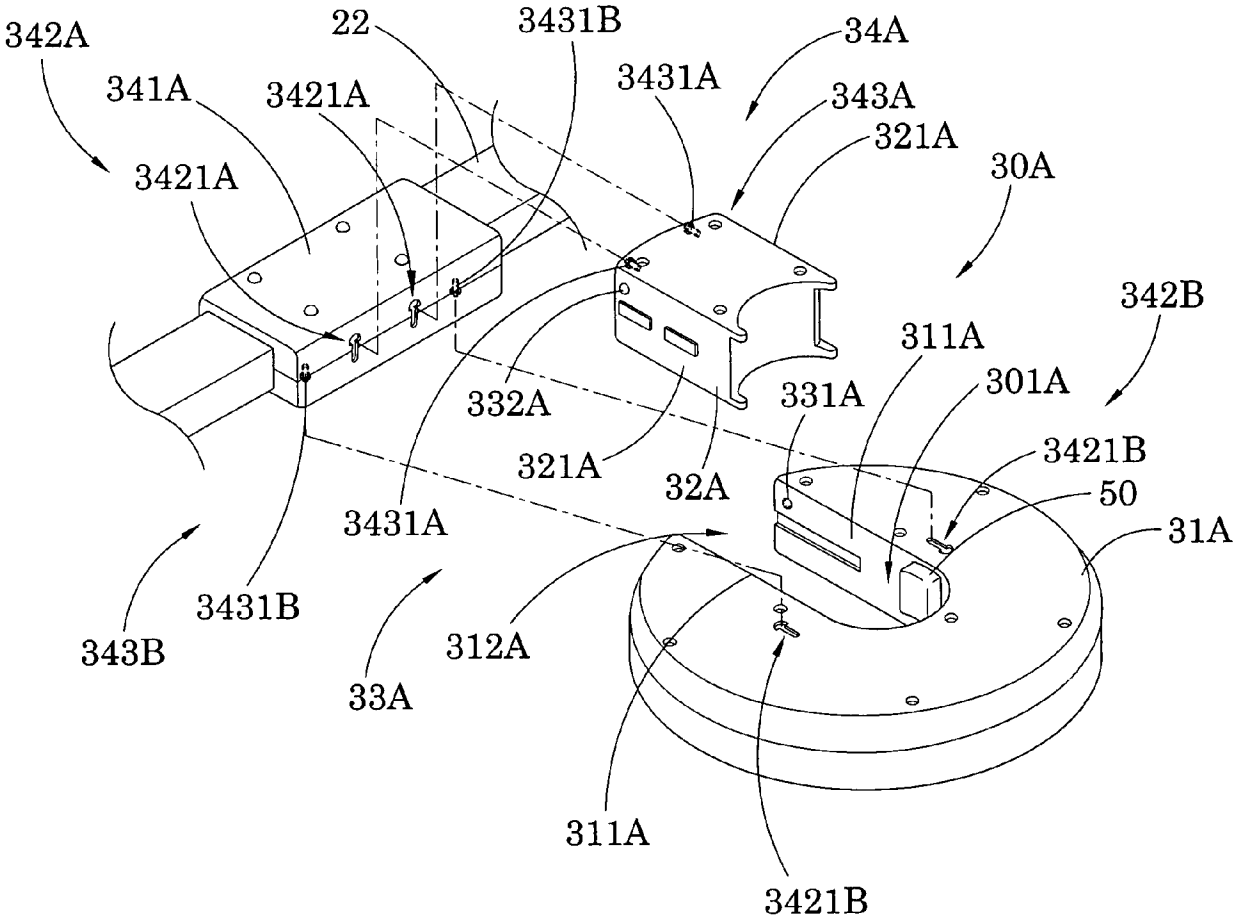
FIG. 10 illustrates the portable accessory device mounting to the awning frame of the outdoor umbrella via the housing according to the above first and second embodiments of the present invention.

FIGS. 9 and 10 illustrate an alternative mode a housing 30A of the portable accessory device 10 with the shaft adjusting arrangement 50 to hold the accessory unit 40, wherein the housing 30A comprises a first housing body 31A and a second housing body 32A defining a mounting slot 301A when the first and second housing bodies 31A, 32A are coupled with each other.

The first housing body 31A, having a U-shaped structure, has two inner guiding walls 311A defining a guiding channel 312A therebetween. The second housing body 32A, having a corresponding elongated shape, has two outer guiding walls 321A engaging with the inner guiding walls 311A of the first housing body 31A. When the first and second housing bodies 31A, 32A are mounted with each other, the housing 30 is formed to have a donut shape and to define the mounting slot 301A at a center of the housing 30A.

In other words, the guiding channel 312A has a closed end defining the mounting slot 301A thereat, and an opened end is arranged when the second housing body 32A is slidably mounted to the first housing body 31A along the guiding channel 312A through the opened end thereof, the mounting slot 301A is formed at the closed end of the guiding channel 312A.

The housing 30A further comprises a housing locker 33A is provided to releasably lock up the second housing body 32A with the first housing body 31A. The housing locker 33A contains two locking slots 331A indently provided at the inner guiding walls 311A of the first housing body 31A respectively and comprises two retractable protrusions 332A sidewardly extended from the outer guiding walls 321A of the second housing body 32A respectively, such that when the second housing body 32A is slid to engage with the first housing body 31A, head portions of the retractable 10 protrusions 332A are engaged with the locking slots 331A respectively so as to lock up the second housing body 32A with the first housing body 31A. It is worth to mention that when a pulling force is applied to the second housing body 32A, the retractable protrusions 332A are retracted to disengage with the locking slots 331A respectively, such that the second housing body 32A is detached from the first housing body 31A.

The portable accessory device 10 further comprises a frame adapter 34A for detachably coupling the housing 30A with the outdoor umbrella 20. As shown in FIG. 9, the frame adapter 34A is adapted for detachably mounting to the umbrella frame 22 of the outdoor umbrella 20. Accordingly, the frame adapter 34A comprises an adapter body 341A, a first connector 342A provided at the adapter body 341A, and a second connector 343A provided at the housing 30A to detachably couple with the first connector 342A so as to detachably couple the housing 30A at the umbrella frame 22 of the outdoor umbrella 20.

The adapter body 341A is embodied as a clip detachably mounted at a desired location of the umbrella frame 22 of the outdoor umbrella 20. The first connector 342A contains two spaced apart retention slots 3421A indently formed at the adapter body 341A, wherein each of the retention slots 3421A has an elongated tail slot portion and an enlarged head slot portion extended therefrom. The second connector 343A comprises two spaced apart retention lockers 3431A protruded from the second housing body 32A, wherein each of the retention lockers 3431A has an elongated tail portion extended from the second housing body 32A and an enlarged head portion extended from the tail portion. Accordingly, the head portions of the retention lockers 3431A are slidably inserted into the head slot portions of the retention slots 3421A and slidably engaged with the tail slot portions thereof respectively to connect the second connector 343A with the first connector 342A. Therefore, the user is able to selectively mount the adapter body 341A at the desired location of the outdoor umbrella 20, as shown in FIG. 9, such that the housing 30A will be supported at the outdoor umbrella 20 via the frame adapter 34A.

Likewise, the frame adapter 34A further comprises supplement first and second connectors 342B, 343B to detachably couple the housing 30A at the umbrella frame 22 of the outdoor umbrella 20. The supplement first connector 342B contains two spaced apart supplement retention slots 3421B indently formed at the first housing body 31A, wherein each of the supplement retention slots 3421B has an elongated tail slot portion and an enlarged head slot portion extended therefrom. The supplement second connector 343B comprises two spaced apart supplement retention lockers 3431B protruded from the frame adapter 34A, wherein each of the retention lockers 3431B has an elongated tail portion extended from the frame adapter 34A and an enlarged head portion extended from the tail portion. Therefore, the housing 30A can be sidewardly mounted to the umbrella frame 22 of the outdoor umbrella 20 via the first and second connectors 342A, 343A or downwardly mounted to the umbrella frame 22 of the outdoor umbrella 20 via the supplemental first and second connectors 342B, 343B, as shown in FIG. 9.

Figure 11:
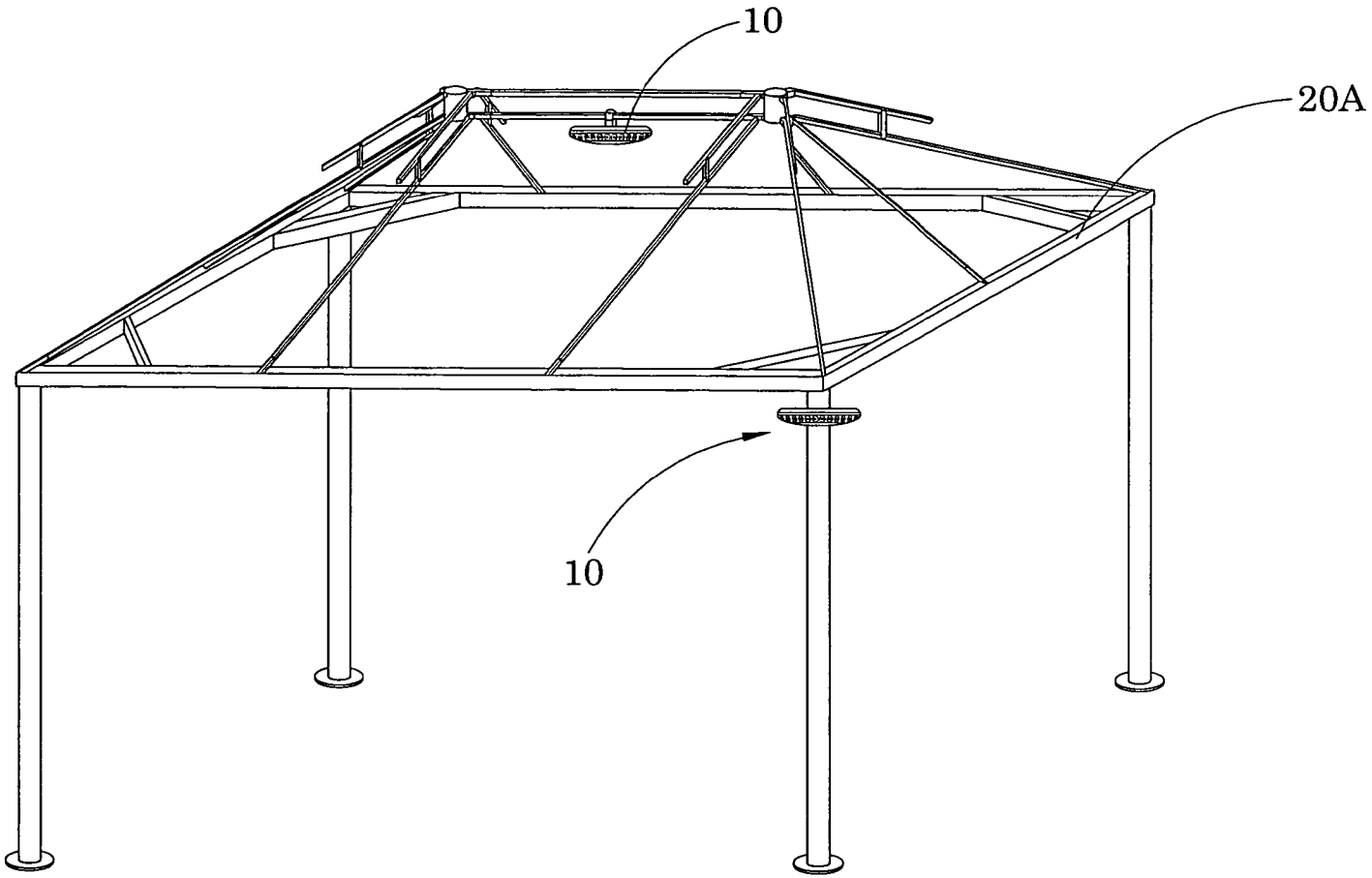
FIG. 11 illustrates the portable accessory device mounting to the awning frame of the canopy via the housing according to the above first and second embodiments of the present invention.

It is worth to mention that the housing 30A can be mounted to a canopy frame of a canopy 20A as shown in FIG. 11. Therefore, the user is able to detachably mount the portable accessory device 10 to the outdoor umbrella 20 or the canopy 20A for providing an addition function for the outdoor umbrella 20 or the canopy 20A.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A portable accessory device for an outdoor umbrella, comprising:

a housing which comprises a first housing body and a second housing body defining a mounting slot when said first and second housing bodies are coupled with each other, wherein said mounting slot has a size for a shaft of said outdoor umbrella fitting therewithin;

an accessory unit supported in said housing for providing an addition function for said outdoor umbrella; and a shaft adjusting arrangement comprising two adjustable retainers for adjusting the size of said mounting slot for said shaft of said outdoor umbrella, wherein each of said adjustable retainers comprises a retention arm, having a pusher surface facing towards said mounting slot, slidably mounted at said first housing body, wherein said pusher surfaces of said retention arms are facing with each other and are arranged for biasing against an outer surface of said shaft of said outdoor umbrella until said shaft thereof being fitted at said mounting slot so as to substantially mount said housing of said portable accessory device at said shaft of said outdoor umbrella, wherein said adjustable retainers are slidably coupled at said first housing body in a radially movable manner at a position that said pusher surfaces of said adjustable retainers are protruded from a circumferential wall of said mounting slot for biasing against said outer surface of said shaft, wherein said shaft adjusting arrangement further comprises two actuating members pivotally supported at said first housing body to couple with said adjustable retainers respectively, wherein each of said actuating members has a pivot end pivotally coupling with said corresponding adjustable retainer and an opposed pushing end arranged in such a manner that when said pushing ends of said actuating members are pressed towards each other to pivotally move said pivot ends thereof away from each other, said adjustable retainers are driven to radially slide away from each other so as to adjust a distance between said pusher surfaces of said adjustable retainers.

2. The portable accessory device, as recited in claim 1, wherein said shaft adjusting arrangement further comprises two resilient elements supported in said first housing body for applying pushing forces against said actuating members respectively, wherein each of said resilient elements has two ends biasing against an inner wall of said first housing body and said pushing end of said respective actuating member.

3. The portable accessory device, as recited in claim 1, wherein said first housing body contains two guiding slots for guiding said adjustable retainers respectively in a radially movable manner, wherein an inner end portion of each of said adjustable retainers is slidably engaged with said respective guiding slot to ensure said adjustable retainer being slid in a radially movable manner.

4. The portable accessory device, as recited in claim 2, wherein said first housing body contains two guiding slots for guiding said adjustable retainers respectively in a radially movable manner, wherein an inner end portion of each of said adjustable retainers is slidably engaged with said respective guiding slot to ensure said adjustable retainer being slid in a radially movable manner.

5. The portable accessory device, as recited in claim 2, wherein said first housing body, having a U-shaped structure, has two inner guiding walls defining a guiding channel therebetween, wherein said second housing body, having a corresponding shape, has two outer guiding walls slidably engaging with said inner guiding walls of said first housing body, wherein said guiding channel has a closed end defining said mounting slot thereat, and an opened end is arranged when said second housing body is slidably mounted to said first housing body along said guiding channel through said opened end thereof, said mounting slot is formed at said closed end of said guiding channel.

6. The portable accessory device, as recited in claim 4, wherein said first housing body, having a U-shaped structure, has two inner guiding walls defining a guiding channel therebetween, wherein said second housing body, having a corresponding shape, has two outer guiding walls slidably engaging with said inner guiding walls of said first housing body, wherein said guiding channel has a closed end defining said mounting slot thereat, and an opened end is arranged when said second housing body is slidably mounted to said first housing body along said guiding channel through said opened end thereof, said mounting slot is formed at said closed end of said guiding channel.

7. The portable accessory device, as recited in claim 5, wherein said pusher surface of each of said adjustable retainers is a curved surface corresponding to a curvature of said shaft of said outdoor umbrella.

8. The portable accessory device, as recited in claim 6, wherein said pusher surface of each of said adjustable retainers is a curved surface corresponding to a curvature of said shaft of said outdoor umbrella.

9. The portable accessory device, as recited in claim 7, wherein each of said adjustable retainers further comprises an anti-slippery pad provided at said pusher surface thereof for enhancing a frictional engagement between said adjustable retainer and said shaft of said outdoor umbrella so as to securely mount said housing at said shaft of said outdoor umbrella.

10. The portable accessory device, as recited in claim 8, wherein each of said adjustable retainers further comprises an anti-slippery pad provided at said pusher surface thereof for enhancing a frictional engagement between said adjustable retainer and said shaft of said outdoor umbrella so as to securely mount said housing at said shaft of said outdoor umbrella.

* * * * *